US009689649B1

(12) United States Patent
Hooke et al.

(10) Patent No.: US 9,689,649 B1
(45) Date of Patent: Jun. 27, 2017

(54) OBTURATOR FOR 105MM PROJECTILE

(71) Applicants: Ryan Hooke, Bangor, PA (US); Christopher Stout, Hoboken, NJ (US)

(72) Inventors: Ryan Hooke, Bangor, PA (US); Christopher Stout, Hoboken, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 335 days.

(21) Appl. No.: 14/464,141

(22) Filed: Aug. 20, 2014

(51) Int. Cl.
*F42B 14/06* (2006.01)

(52) U.S. Cl.
CPC ..... *F42B 14/06* (2013.01)

(58) Field of Classification Search
CPC ..... F42B 14/06; F42B 14/02; F42A 3/74
See application file for complete search history.

(56) References Cited

U.S. PATENT DOCUMENTS 1,446,764 A * 2/1923 Nichols ..... F42C 5/00 102/273
1,757,675 A * 5/1930 Methlin ..... F41F 1/06 102/430
2,487,053 A * 11/1949 Hickman ..... F42B 15/00 102/374
2,514,297 A * 7/1950 Smith, Jr. ..... F42C 11/02 102/210
2,595,757 A * 5/1952 Brandt ..... F42C 1/02 102/249
2,773,448 A * 12/1956 Jasse ..... F42B 5/16 102/379
3,685,392 A * 8/1972 Platt ..... F42B 3/113 102/201
3,695,181 A * 10/1972 Bull ..... F42B 14/064 102/522
3,769,912 A * 11/1973 Friend ..... F42B 14/064 102/522
3,786,760 A * 1/1974 Feldmann ..... F42B 14/02 102/527
3,862,603 A * 1/1975 Kornblith ..... F42B 14/061 102/522
3,905,291 A * 9/1975 Corbin, Jr. ..... F42B 3/04 102/430
3,994,227 A * 11/1976 Harvey ..... F42B 23/16 102/254
4,040,359 A * 8/1977 Blajda ..... F42B 14/02 102/527
4,123,975 A * 11/1978 Mohaupt ..... F42B 12/06 102/518
4,296,687 A * 10/1981 Garrett ..... F42B 14/064 102/518
4,301,736 A * 11/1981 Flatau ..... F42B 10/34 102/501

(Continued)

*Primary Examiner* — Samir Abdosh
(74) *Attorney, Agent, or Firm* — Michael C. Sachs

(57) ABSTRACT

A high efficiency, blow-by reducing obturator for a 105 mm tube-launched projectile is a generally annular ring having a central longitudinal axis and an outer circumferential surface. The outer surface has a first portion parallel to the central longitudinal axis and a second portion adjacent to the first portion. The second portion extends forward and radially inward at an angle of about six degrees with the central longitudinal axis. In some embodiments, one or more grooves are formed in the inner circumferential surface of the ring.

2 Claims, 4 Drawing Sheets

(56) References Cited

U.S. PATENT DOCUMENTS 4,307,666 A * 12/1981 Baran ..... F42B 14/02
102/501
4,384,529 A * 5/1983 Burns ..... F42B 14/02
102/520

* cited by examiner

OBTURATOR FOR 105MM PROJECTILE

STATEMENT OF GOVERNMENT INTEREST

The inventions described herein may be manufactured, used and licensed by or for the United States Government.

BACKGROUND OF THE INVENTION

The invention relates in general to tube-launched projectiles and in particular to obturators for tube-launched projectiles.

An obturator may be used with a tube-launched projectile to seal propellant gas behind the obturator. In rifled launch tubes, the obturator may also function as a torque or spin regulating device to regulate the amount of spin transferred from the obturator to the projectile.

U.S. Pat. No. 6,085,660 issued on Jul. 11, 2000 to Campoli et al. discloses a low spin sabot having a slip obturator with ports to help reduce the spin rate of tank ammunition. U.S. Pat. No. 4,109,582 issued to Haep et al. on Aug. 29, 1978 discloses twist-reducing rings for stabilized projectiles. U.S. Pat. No. 5,164,540 issued to Chiarelli et al. on Nov. 17, 1992 discloses a slipping driving band for projectiles of any caliber. A slip obturator made of composite material has been used with the M712 Copperhead projectile. A discarding slip obturator made of polyetheretherketone (PEEK) has been used with the M982 Excalibur projectile.

Some projectiles (e.g., 155 mm artillery projectiles) are "hard" loaded from the breech end of a launching tube by ramming the projectile into the forcing cone area of the tube. When the projectile is rammed into the forcing cone area, the obturator on the projectile is deformed by mechanical interference with the forcing cone surface. The propellant is placed behind the projectile and the breech is closed. Other projectiles (e.g., 105 mm projectiles) may use a different, so-called "soft" loading procedure.

The soft loading procedure uses semi-fixed ammunition. Semi-fixed ammunition is manually prepared by placing propellant in a cartridge case and then placing a projectile on the cartridge case. The gunner than manually chambers the projectile and cartridge case in the breech of the launch tube by pushing on the base of the cartridge case with his/her fist, thereby sliding the projectile into the forcing cone area. Manually sliding the projectile into the forcing cone area produces little or no mechanical interference between the projectile's obturator and the forcing cone surface. Then, the slightly tapered breech closure slides upward and locks into place, thereby setting the cartridge case and projectile. In some cases, it may be difficult to close the breech because the projectile will not move forward sufficiently into the forcing cone area.

Among other factors, the amount of mechanical interference between the obturator and the forcing cone surface determines the amount of initial propellant gas blow-by past the obturator. The initial gas blow-by for a soft loaded projectile is greater than for a hard loaded projectile and is difficult to control. The greater blow-by causes, among other things, loss of propellant gas pressure and excessive heat and pressure applied to areas of the round forward of the obturator.

The amount of mechanical interference between the obturator and the projectile is also important. When the projectile is fired and moves forward through the forcing cone area, mechanical interference between the obturator and the forcing cone surface tends to swage the inner surface of the obturator onto the outer surface of the projectile. The swaging of the obturator to the projectile imparts torque and spin to the projectile. However, for precision guided munitions that are fin-stabilized, high spin rates may be undesirable.

A need exists for an efficient obturator for a soft loaded 105 mm projectile that enables ease of loading of the projectile in the gun, reduces initial blow-by and imparts reduced torque to the projectile.

SUMMARY OF INVENTION

One aspect of the invention is an obturator for a 105 mm tube-launched projectile having a central longitudinal axis and a circumferential obturator slot. The obturator includes a generally annular ring having a central longitudinal axis and an outer circumferential surface. The outer circumferential surface includes first and second portions. The first portion begins at an aft face of the ring and extends forward parallel to the central longitudinal axis. The second portion is adjacent to the first portion and extends forward and radially inward at an angle of about six degrees with the central longitudinal axis.

The inner circumferential surface of the obturator includes at least one groove formed therein. The groove extends around the inner circumferential surface of the ring. In one embodiment, the at least one groove includes a plurality of discrete, parallel, spaced-apart grooves extending circumferentially around the inner circumferential surface of the ring. In another embodiment, the at least one groove is a continuous helical groove.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1C:
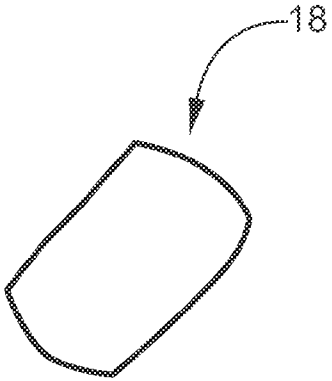
FIG. 1C PRIOR ART
FIG. 1C is a schematic of a bag of propellant.
Figure 1B:
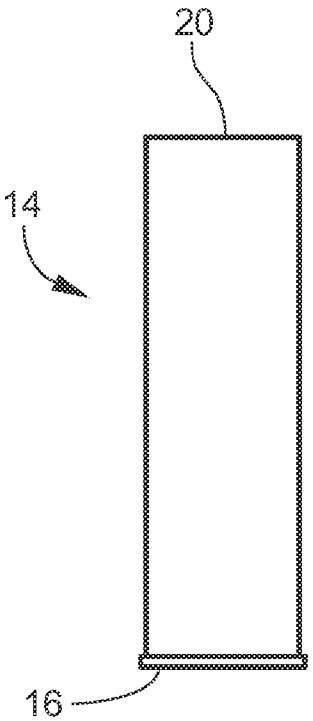
FIG. 1B PRIOR ART
FIG. 1B is a schematic of a 105 mm cartridge case.
Figure 1A:
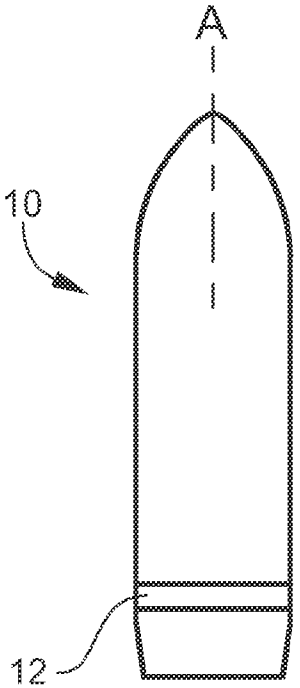
FIG. 1A PRIOR ART
FIG. 1A is a schematic of a 105 mm projectile.

FIG. 1A shows a 105 mm projectile 10 having a circumferential slot 12 for receiving an obturator and a central longitudinal axis A. FIG. 1B shows a 105 mm cartridge case 14 having a base 16 and an open end 20. FIG. 1C shows a bag 18 of propellant. In semi-fixed 105 mm ammunition, one or more bags 18 of propellant are manually placed in the case 12 and then the projectile 10 is manually placed on the open end 20 of the case 12. The case 12 and projectile 10 are then manually soft loaded by a gunner in a launching tube.

Figure 2C:
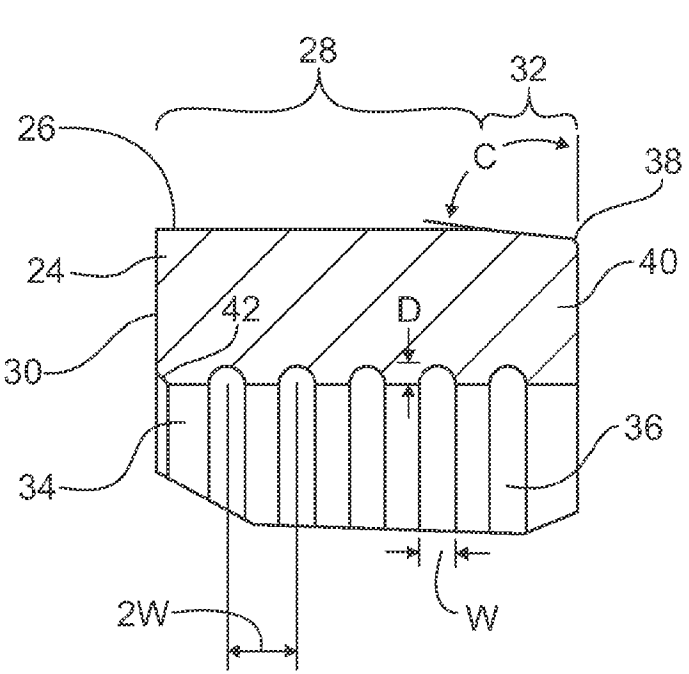
FIG. 2C is an enlarged view of a portion of FIG. 2B.
Figure 2B:
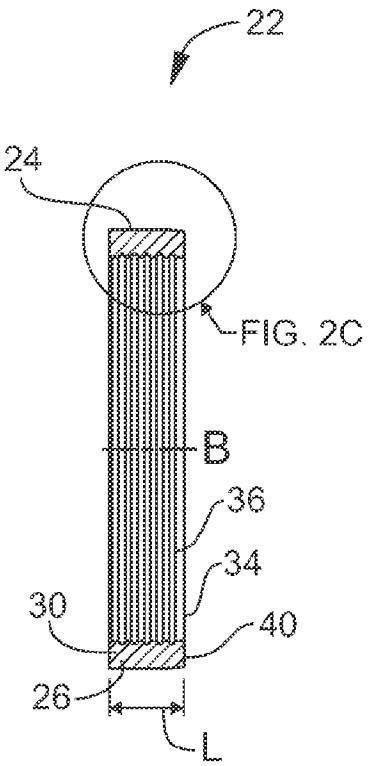
FIG. 2B is a sectional view along the line 2B-2B of FIG. 2A.
Figure 2A:
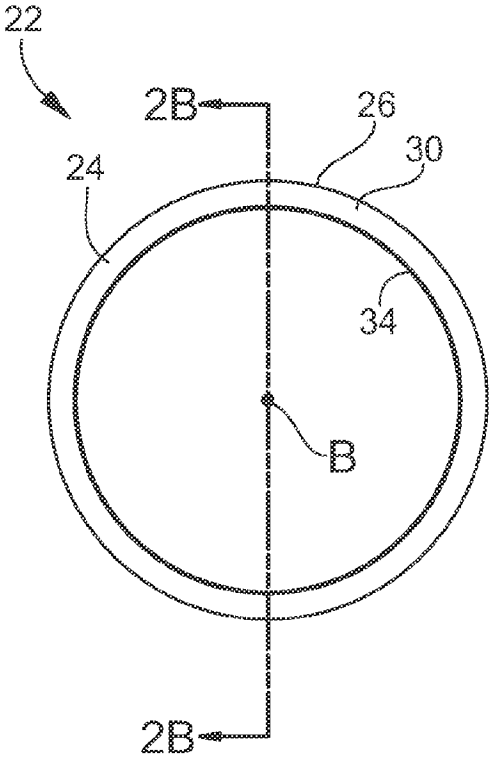
FIG. 2A is a rear view of one embodiment of an obturator for a 105 mm projectile.

A novel obturator for a 105 mm projectile has a leading geometry tailored for the forcing cone of a 105 mm cannon in which the 105 mm rounds are manually soft loaded. Such geometry ensures mechanical interference with the forcing cone for shot start sealing while also ensuring the ability to close a sliding breech. FIG. 2A is a rear view of one embodiment of an obturator 22 for a 105 mm projectile, such as projectile 10. FIG. 2B is a sectional view along the line 2B-2B of FIG. 2A. FIG. 2C is an enlarged view of a portion of FIG. 2B.

Obturator 22 includes a generally annular ring 24 having a central longitudinal axis B coincident with axis A of projectile 10. Ring 24 may be made of an engineered thermoplastic material having a low coefficient of friction, low creep, low water absorption and a chemical resistance to grease. Examples of suitable materials are polyetheretherketone (PEEK) and Amodel®.

Ring 24 has an outer circumferential surface 26. Surface 26 (FIG. 2C) includes a first portion 28 beginning at an aft face 30 of the ring 24 and extending forward and parallel to axis B. A second portion 32 is adjacent to the first portion 28 and extends forward and radially inward at an angle C of about 84 degrees measured from a normal to axis B (or about 6 degrees with respect to axis B). Preferably, angle C is 84.3 degrees.

An inner circumferential surface 34 includes at least one groove 36 formed therein. In the embodiment of FIGS. 2A-C, surface 34 has a plurality of grooves 36 formed therein. Five grooves 36 are shown. The amount of torque transferred from obturator 22 to projectile 10 may be varied by varying the number of grooves 36. In general, fewer grooves 36 result in increased torque transfer. Grooves 36 extend around the inner circumferential surface 34 of the ring 24. Grooves 36 are discrete, longitudinally spaced-apart and parallel to each other. Each groove 36 may have, for example, a semi-circular shape, as shown. Each groove 36 may have a depth D equal to one half its width W. The width W of each groove 36 may be the same and adjacent groove centerlines may be spaced apart an amount equal to twice the groove width W.

The axial length L of the ring 24 may be less than one inch. The axial length of the first portion 28 of the outer circumferential surface 26 may be about seventy-seven percent of the axial length L. Optionally, the outer circumferential surface 26 includes a beveled surface 38 at the front face 40. The beveled surface 38 may be angled at 45 degrees with respect to axis B. Also, and optionally, the inner circumferential surface 34 may include a beveled surface 42 at the all face 30. Beveled surface 42 may be angled at 45 degrees with respect to axis B.

Figure 3C:
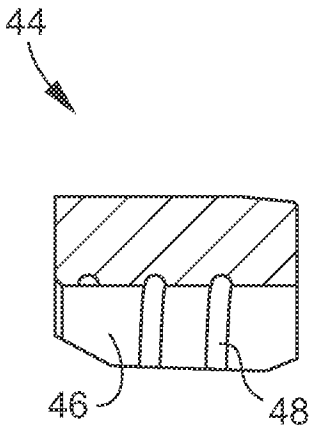
FIG. 3C is an enlarged view of a portion of FIG. 3B.
Figure 3B:
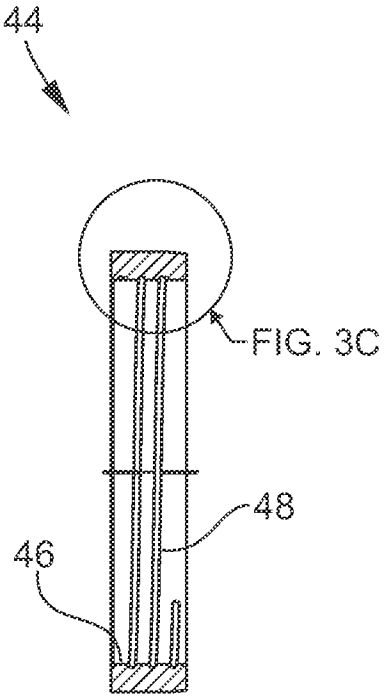
FIG. 3B is a sectional view along the line 3B-3B of FIG. 3A.
Figure 3A:
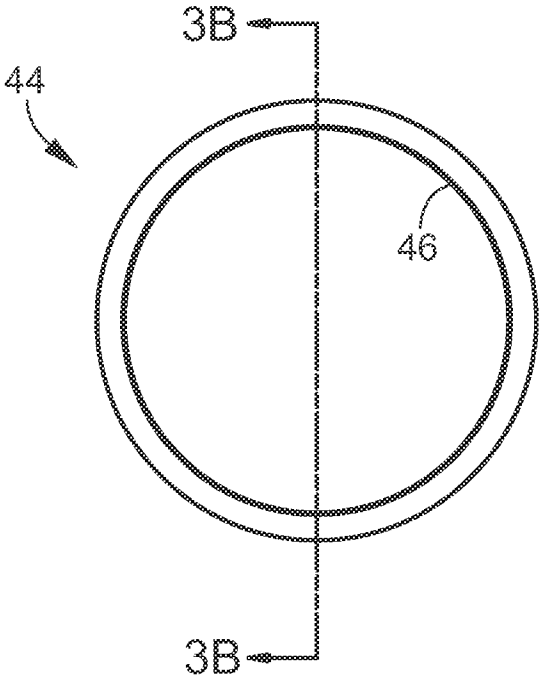
FIG. 3A is a rear view of another embodiment of an obturator for a 105 mm projectile.

FIG. 3A is a rear view of another embodiment of an obturator 44 for a 105 mm projectile. FIG. 3B is a sectional view along the line 3B-3B of FIG. 3A. FIG. 3C is an enlarged view of a portion of FIG. 3B. Obturator 44 may be the same as obturator 22 except for the grooves 36 of obturator 22. In obturator 44, the inner circumferential surface 46 has a single, continuous helical groove 48 formed therein, having high portions called crests and also low points called depths. Helical groove 48 may have, for example, a semi-circular shape. Helical groove 48 may have a constant width and a constant depth. The depth of groove 48 may be equal to one half of its width. In one embodiment, the pitch of the helical groove 48 may be constant. The pitch may be in a range of about 0.15 to 0.25 inches, being the distance from crest to crest, which would also be equal to 0.15 to 0.25 inches per one rotation if the thread had been rotated, e.g. In other embodiments, the pitch of the helical groove may be made to vary. For example, the pitch may progressively increase or decrease axially.

Compared to an obturator with no grooves, the grooves 36, 48 of obturators 22, 44 reduce the amount of contact area capable of transmitting torque between the obturator and the projectile 10. The grooves 36, 48 provide space for the obturator to deform, reduce friction between the obturator and the projectile 10, and provide space for grease and debris to collect. If there were no space in which to collect debris, the debris may increase friction between the obturator and the projectile 10. Increased friction may undesirably increase the spin rate of the projectile 10. Grease may be applied in the grooves. The helical groove 48 is advantageous because a new layer of lubricant may be applied on each revolution of the obturator and the bearing surface cleaned on each revolution of the obturator. The grooves can also choke gas flow which attempts to pass under the obturator, thereby increasing the sealing capability of the obturator compared to an obturator with no grooves.

Figure 4C:
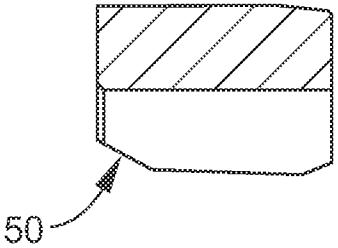
FIG. 4C is an enlarged view of a portion of FIG. 4B.
Figure 4B:
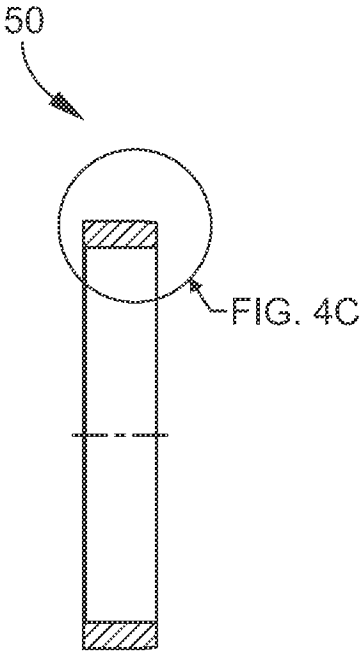
FIG. 4B is a sectional view along the line 4B-4B of FIG. 4A.
Figure 4A:
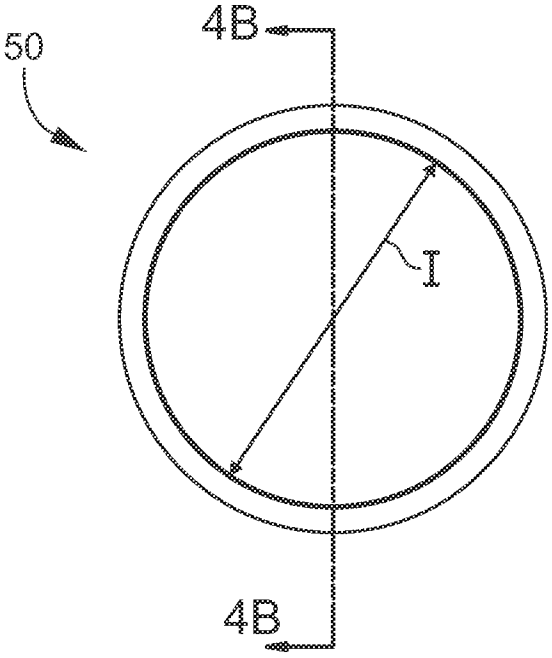
FIG. 4A is a rear view of another embodiment of an obturator for a 105 mm projectile.

FIG. 4A is a rear view of another embodiment of an obturator 50 for a 105 mm projectile. FIG. 4B is a sectional view along the line 4B-4B of FIG. 4A. FIG. 4C is an enlarged view of a portion of FIG. 4B. Obturator 50 is the same as obturators 22 and 44 except no grooves are formed in the inner circumferential surface 52 of obturator 50. Obturator 50 may be used for spin stabilized projectiles in which torque transfer is desired. For effective torque transfer, the inner diameter I of obturator 50 may be sized to provide an interference fit with obturator slot 12 (FIG. 1A).

Preliminary test results of the grooved obturators 22, 44 show a desired decoupling of the torque, resulting in a reduced spin rate of the projectiles (on the order of 10-30 Hz). In addition, the muzzle velocities measured when using the grooved obturators 22, 44 show an increase, which indicates decreased blow-by gas. High speed video of test shots also show a decrease in muzzle flash prior to the projectile exiting the tube. The decreased muzzle flash is an indication of decreased blow-by and increased efficiency of the obturator.

While the invention has been described with reference to certain embodiments, numerous changes, alterations and modifications to the described embodiments are possible without departing from the spirit and scope of the invention as defined in the appended claims, and equivalents thereof.

What is claimed is:

1. An obturator for a 105 mm tube-launched projectile having a central longitudinal axis and a circumferential obturator slot, the obturator comprising:

a generally annular ring having a central longitudinal axis an outer circumferential surface including a first portion beginning at an aft face of the ring and extending forward parallel to the central longitudinal axis, a second portion adjacent to the first portion and extending forward and radially inward at an angle of six degrees with the central longitudinal axis; and an inner circumferential surface including a single, continuous helical groove formed therein, the groove extending around the inner circumferential surface of the ring and having a semi-circular shape, a depth equal to one half its width, and a pitch in a range of 0.15 to 0.25 inches distance from one crest to the next crest.

2. The obturator of claim 1, wherein an axial length of the ring is less than one inch and an axial length of the first portion of the outer circumferential surface is seventy-seven percent of the axial length of the ring.

* * * * *